US012624691B2

(12) United States Patent
Ramaswamy

(10) Patent No.: US 12,624,691 B2
(45) Date of Patent: May 12, 2026

(54) ROBUST DOWNHOLE PUMP BARREL

(71) Applicant: Q2 ARTIFICIAL LIFT SERVICES LLC, Midland, TX (US)

(72) Inventor: Santhosh Ramaswamy, Conroe, TX (US)

(73) Assignee: Q2 ARTIFICIAL LIFT SERVICES LLC, Midland, TX (US)

( * ) Notice: Subject to any disclaimer, the term of this patent is extended or adjusted under 35 U.S.C. 154(b) by 0 days.

(21) Appl. No.: 18/804,918

(22) Filed: Aug. 14, 2024

(65) Prior Publication Data

US 2025/0154945 A1 May 15, 2025

Related U.S. Application Data

(60) Provisional application No. 63/520,028, filed on Aug. 16, 2023.

(51) Int. Cl.

| | |
|---|---|
| ***F04B 47/02*** | (2006.01) |
| ***E21B 17/10*** | (2006.01) |
| ***E21B 17/12*** | (2006.01) |
| ***E21B 25/08*** | (2006.01) |
| ***E21B 33/037*** | (2006.01) |
| ***F04B 15/04*** | (2006.01) |
| ***F04B 53/16*** | (2006.01) |

(52) U.S. Cl.

CPC ..... *F04B 47/028* (2013.01); *F04B 15/04* (2013.01); *E21B 17/1035* (2013.01); *E21B 17/1071* (2013.01); *E21B 17/12* (2013.01); *E21B 25/08* (2013.01); *E21B 33/0375* (2013.01); *F04B 53/162* (2013.01)

(58) Field of Classification Search

CPC combination set(s) only.
See application file for complete search history.

(56) References Cited

U.S. PATENT DOCUMENTS

| | | | | |
|---|---|---|---|---|
| 10,138,884 | B2 | 11/2018 | Stachowiak, Jr. | |
| 10,626,708 | B2 | 4/2020 | Cedillo et al. | |
| 2008/0196235 | A1 | 8/2008 | Gereluk | |
| 2015/0064034 | A1* | 3/2015 | Davis | E21B 43/128 210/323.1 |
| 2016/0090824 | A1* | 3/2016 | Overstreet | B23K 26/34 175/425 |
| 2016/0160370 | A1* | 6/2016 | Sista | C25D 9/08 166/243 |

(Continued)

OTHER PUBLICATIONS

Torun, Celikyurek, Boriding of difusion bonded joints of pure nickel to commercially pure titanium, Materials and Design 30 (2009).

(Continued)

*Primary Examiner* — Binh Q Tran
(74) *Attorney, Agent, or Firm* — Smith Baluch LLP

(57) ABSTRACT

A downhole pump barrel is nickel plated to a predefined thickness followed by Boronizing a portion of nickel matrix to create Nickel Boride layer and leaving a layer of nickel between the newly formed Nickel Boride and the barrel metal surface. The top layer of Nickel Boride provides a hard surface like chrome plating which increases the wear/abrasion resistance during the sucker rod pump production. The nickel matrix disposed beneath the Nickel Boride acts as a barrier from any corrosion attacks reaching the barrel metal surface.

20 Claims, 6 Drawing Sheets

(56) References Cited

U.S. PATENT DOCUMENTS

| | | | | |
|---|---|---|---|---|
| 2016/0177944 | A1* | 6/2016 | Stachowiak, Jr. | C23C 18/1653 205/180 |
| 2017/0292353 | A1* | 10/2017 | Liu | F04B 47/02 |
| 2018/0106250 | A1* | 4/2018 | Kool | C23C 18/1662 |
| 2020/0115998 | A1 | 4/2020 | Lomasney | |
| 2023/0392475 | A1* | 12/2023 | Marya | C02F 1/48 |

OTHER PUBLICATIONS

International Search Report and Written Opinion of the International Searching Authority for PCT/US24/42298.

* cited by examiner

ROBUST DOWNHOLE PUMP BARREL

CROSS REFERENCE TO RELATED APPLICATIONS

This application claims priority to U.S. Provisional Patent Application No. 63/520,028, filed on Aug. 16, 2023, the entire contents of which are incorporated herein for all purposes.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The present disclosure generally relates to a downhole bump barrel for use in a downhole artificial lift of the type that may be used to remove hydrocarbons from the ground. The disclosed elements and processes, however, may have applications outside the disclosed field and this description is not intended to limit the scope of the claimed subject matter in any way.

Description of the Related Art

Downhole sucker-rod pumps are used in sucker-rod type artificial lift systems. Such systems conventionally include a number of different components including those illustrated in FIG. 1, below.

FIG. 1 depicts a conventional sucker-rod artificial lift system 10 that includes, a movable assembly 11 that includes a traveling valve 12; a plunger 13; a coupling plunger 14; a valve rod 16 and a valve rod bushing 18.

In the example of FIG. 1, in use, the movable assembly 10 is typically positioned within a stationary assembly 20 such that the movable assembly 10 may be stroked upwardly and downwardly within the stationary assembly 10. The movement producing the stroking may result from, for example, the coupling of the movable assembly 10 to a beam pumping unit (not illustrated in FIG. 1).

In the example of FIG. 1, a conventional stationary assembly 10 is depicted that includes a hold-down assembly (comprising elements 21*a* and 21*b*); a standing valve 22; a barrel 24; barrel connector 26 and a valve rod guide 28.

During use movement of the movable assembly 11 within the stationary assemble 20 will result operation of a pump assemble in which: (a) a volume of production fluid is received within the barrel 24—through the plunger 13 and the traveling valve 12—during each typical downstroke and (b) a volume of production fluid is lifted through the annulus that will exist between the inner walls of the barrel 24 and the exterior of the movable assembly 11 during each typical upstroke. Thus, in the described system, production fluid will be received within, and move within, the interior space of the barrel 24 during each upstroke.

As those of ordinary skill in the art will appreciate, production fluid in a downhole well typically contains particles of various sizes (sand, for example), potentially corrosive materials; and or potentially abrading materials.

As such, the interior of the barrel 24 is subject to harsh conditions tending to promote wear, abrasion and/or cracking. Such conditions can result in damage and/or deterioration of the material forming the barrel 24 resulting in failure of the artificial lift system 100, sub-optimum performance of the system 100, and/or undesired wear of the system 100.

The problem of undesired wear and/or corrosion of barrel surfaces has been long-standing within the relevant art and various approaches have been attempted to increase the wear/abrasion resistance of barrels. But to date, such attempts have been sub-optimal.

For example, it has been known to coat the inner surface of a barrel formed primarily from iron with a layer of chrome to increase the wear/abrasion of a barrel. One example of such an approach is reflected in FIG. 2, below, in which a portion of the barrel metal surface 100 is shown as being coated with a chrome layer 101. One deficiency of this approach is that, upon use, micro-cracks can form within the chrome layer 101 that can easily propagate through the chrome layer 101, producing crevasses through which the corrosive and/or wearing fluid can pass and contact the barrel metal surface 100, thus damaging the metal surface.

An alternate approach for that has been attempted to protect barrel surfaces within an artificial lift system involves the use of a NiCarb (or Ni-Carb) coating. One example of such an approach may be found in FIG. 3, below. FIG. 3 depicts a portion of a barrel that includes a metal barrel surface 100 to which has been applied a coating 105 that comprises carbide particles 106 dispersed within a nickel matrix 105. While this approach can be beneficial in some applications, and provide a degree of corrosion and wear resistance, it is not an optimal approach because the presence of abrasive particles, such as sand, within a production fluid can penetrate and/or strip away the relatively soft nickel matrix 105, and—over time—remove the coating from the barrel metal surface 100, thus exposing the surface 100 to the harsh production fluid.

A still further alternate approach—similar to that disclosed in U.S. Pat. No. 10,138,384—is reflected in FIG. 4, below, which shows a barrel surface that includes a barrel metal surface 100 to which a nickel matrix 107 has been applied, and to which a subsequent chrome plating layer 108 has been applied. While this approach can provide advantages in some applications, it is not optimum for several reasons. For example, this process requires preparing the nickel matrix surface to facilitate the adhesion of the chrome layer that will be deposited on the nickel surface. Such preparation (sometimes called activating the nickel) can be time-consuming and costly because it will commonly require a thorough cleaning step, an etching step, and a reducing or activating step. A further limitation of this process is that the ability of a nickel layer to receive a subsequent chrome layer degrades (sometimes rapidly) after the conclusion of a nickel activating step. As such, to implement the approach shown in FIG. 4, the chrome plating step must typically rapidly follow the nickel activation step. The necessity of completing these steps within a limited time period places constraints on the manufacturability of any product using the approach of FIG. 4.

FIG. 5, below, depicts yet another attempted approach for solving the long-standing problem of avoiding undesired wear and abrasion in the context of a downhole pump barrel. In the approach of FIG. 5, a barrel formed of iron and having a barrel metal surface 100 is subjected to a process in which Boron particles are diffused into the metal surface 100 to for an Iron Boride (FeB or Fe2B) layer 109. (It will be understood that references herein to a FeB layer shall be understood to alternatively refer to a Fe2B layer.) The FeB layer 109 is beneficial in some respects in that it can be harder than an outer chrome layer. However, such an FeB layer 109 can be brittle such that use (or straightening) of the depicted barrel can produce or expand micro-cracks within the layer 109 that can permit corrosive elements (such as element 111) from the downhole production fluid to penetrate through the cracks to reach the iron barrel surface 100, thus deteriorating the barrel life.

It is an object of the disclosure contained herein to overcome the described and other limitations of known approaches for enhancing the lifespan and operation of downhole pump barrels.

It is to be understood that the discussion above is provided for illustrative purposes only and is not intended to and does not limit the scope or subject matter of the appended or ultimately issued claims or those of any related patent application or patent. Thus, none of the appended claims, ultimately issued claims or claims of any related application or patent are to be limited by the above discussion or construed to address, include, or exclude each or any of the above-cited features or disadvantages merely because such were mentioned herein.

BRIEF SUMMARY OF THE INVENTION

A brief non-limiting summary of one of the many possible embodiments of the inventions disclosed herein is a barrel for use in a sucker-rod pump assembly, comprising: a tubular core element comprising iron, the tubular core element defining an interior surface and a longitudinal axis; an interior layer formed on at least a portion of the interior surface, the interior layer including: a first region comprising Nickel Boride, wherein the thickness of the first region, when measured in a direction perpendicular to the longitudinal axis, is in the range of approximately 40 microns to 80 microns; and a second region substantially free of Boron, wherein the thickness of the second region, when measured in a direction perpendicular to the longitudinal axis, is in the range of approximately 1 micron to 40 microns; and wherein the second region is closer to the interior surface of the core element than the first region, when considered in a direction perpendicular to the longitudinal axis.

Additionally or alternately, the second region can consists of nickel plate.

None of these brief summaries of the inventions is intended to limit or otherwise affect the scope of what has been disclosed and enabled or the appended claims, and nothing stated in this Brief Summary of the Invention is intended as a definition of a claim term or phrase or as a disavowal or disclaimer of claim scope.

BRIEF DESCRIPTION OF THE SEVERAL VIEWS OF THE DRAWINGS

The following figures form part of the disclosure of inventions and are included to demonstrate further certain aspects of the inventions. The inventions may be better understood by reference to one or more of these figures in combination with the detailed description of certain embodiments presented herein in which.

Figure 1:
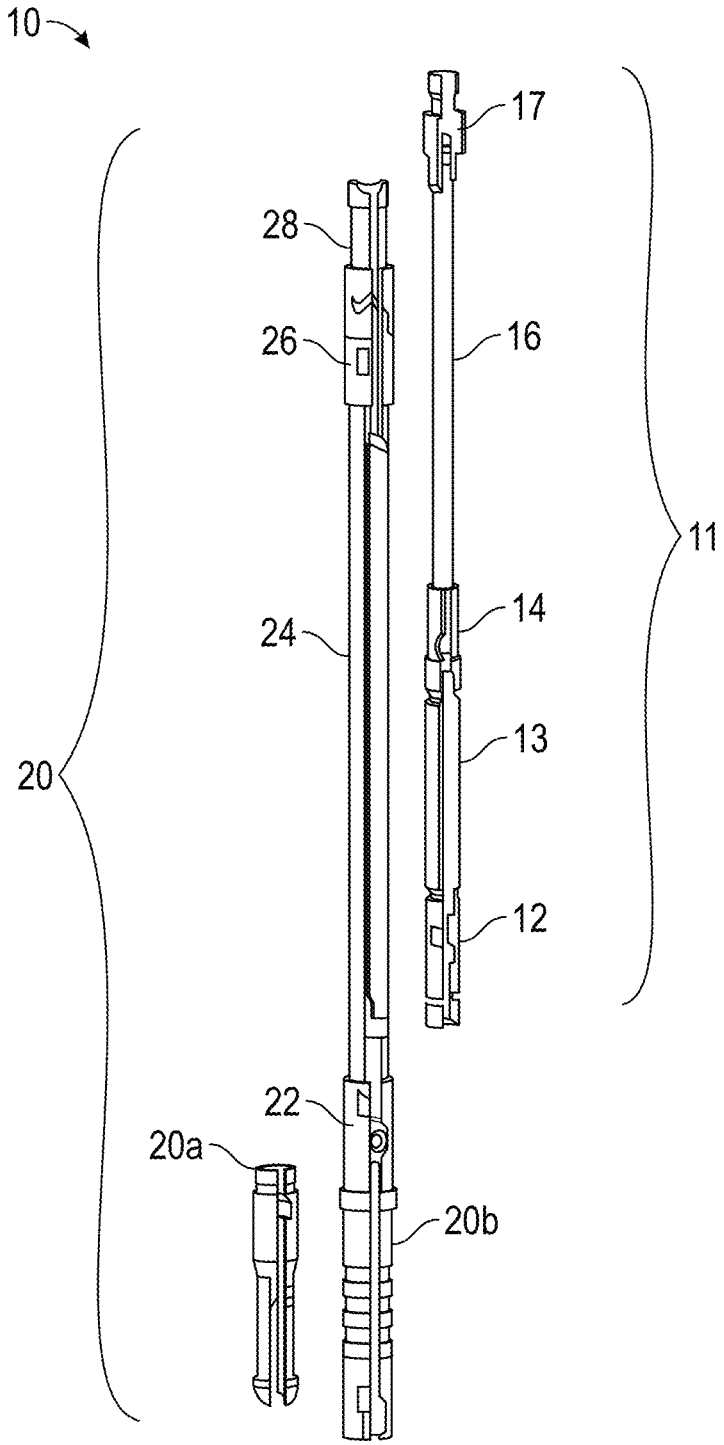
FIG. 1 depicts a conventional sucker-rod artificial lift system that includes, a movable assembly that includes a traveling valve; a plunger a coupling plunger; a valve rod and a valve rod bushing.
Figure 2:
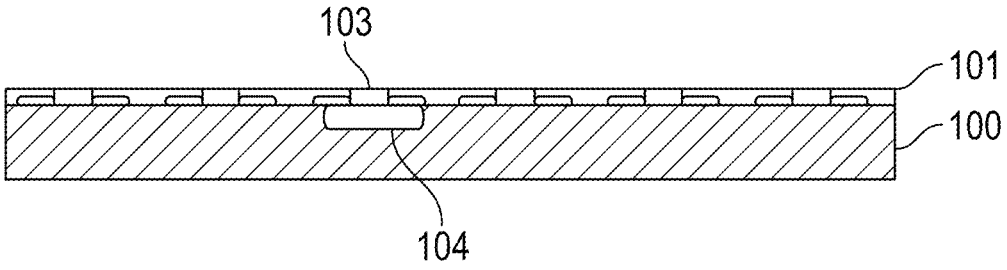
FIG. 2 (Prior Art)
FIG. 2, illustrates a portion of a barrel metal surface ng coated with a chrome layer.
Figure 3:
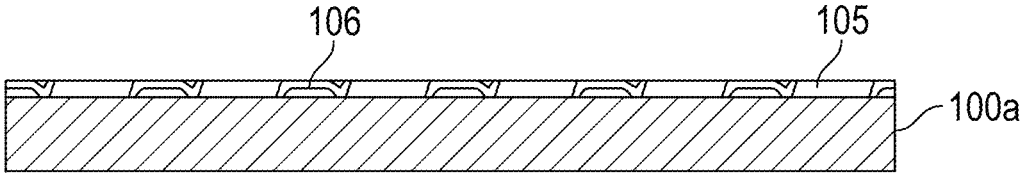
FIG. 3 (Prior Art)
FIG. 3 depicts a portion of a barrel that includes a metal barrel surface to which has been applied a coating that comprises carbide particles dispersed within a nickel matrix.
Figure 4:
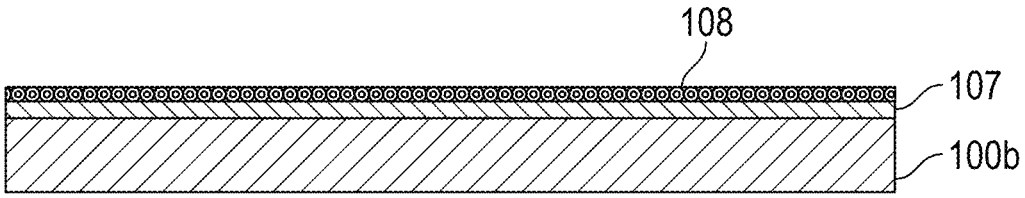
FIG. 4 (Prior Art)
FIG. 4 shows a barrel surface that includes a barrel metal surface to which a nickel matrix has been applied, and to which a subsequent chrome plating layer has been applied.
Figure 5:
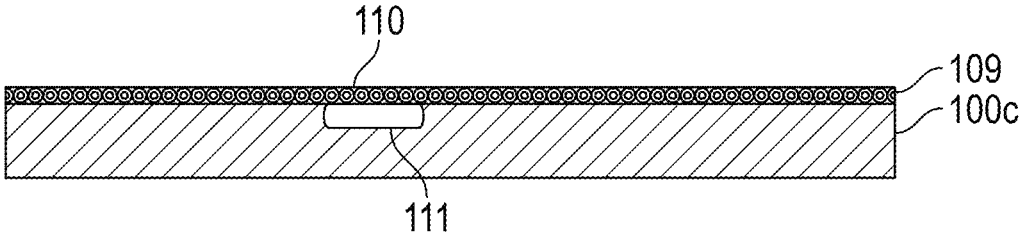
FIG. 5 (Prior Art)
FIG. 5 illustrates barrel formed of iron and having a barrel metal surface 100 is subjected to a process in which Boron particles are diffused into the metal surface 100 to for an Iron Boride (FeB) layer 109.

While the inventions disclosed herein are susceptible to various modifications and alternative forms, only a few specific embodiments have been shown by way of example in the drawings and are described in more detail below. The figures and detailed descriptions of these embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts illustrated and taught by the specific embodiments.

DETAILED DESCRIPTION

The Figures described above, and the written description of specific structures and functions below, are not presented to limit the scope of the inventions disclosed or the scope of the appended claims. Rather, the Figures and written description are provided to teach a person skilled in this art to make and use the inventions for which patent protection is sought.

A person of skill in this art having benefit of this disclosure will understand that the inventions are disclosed and taught herein by reference to specific embodiments, and that these specific embodiments are susceptible to numerous and various modifications and alternative forms without departing from the inventions we possess. For example, and not limitation, a person of skill in this art having benefit of this disclosure will understand that Figures and/or embodiments that use one or more common structures or elements, such as a structure or an element identified by a common reference number, are linked together for all purposes of supporting and enabling our inventions, and that such individual Figures or embodiments are not disparate disclosures. A person of skill in this art having benefit of this disclosure immediately will recognize and understand the various other embodiments of our inventions having one or more of the structures or elements illustrated and/or described in the various linked embodiments. In other words, not all possible embodiments of our inventions are described or illustrated in this application, and one or more of the claims to our inventions may not be directed to a specific, disclosed example. Nonetheless, a person of skill in this art having benefit of this disclosure will understand that the claims are fully supported by the entirety of this disclosure.

Those persons skilled in this art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of skill in this art having benefit of this disclosure.

Further, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the scope of what is claimed.

Reference throughout this disclosure to "one embodiment," "an embodiment," or similar language means that a particular feature, structure, or characteristic described in connection with the embodiment is included in at least one of the many possible embodiments of the present inventions. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

The description of elements in each Figure may refer to elements of proceeding Figures. Like numbers refer to like elements in all figures, including alternate embodiments of like elements.

Turning now to several descriptions, with reference to Figures, of particular embodiments incorporating one or more aspects of the disclosed inventions, FIGS. 6A-6B, below, illustrate aspects of a barrel for use in a sucker-rod pump assembly constructed in accordance with certain teachings of the present disclosure.

Figure 6A:
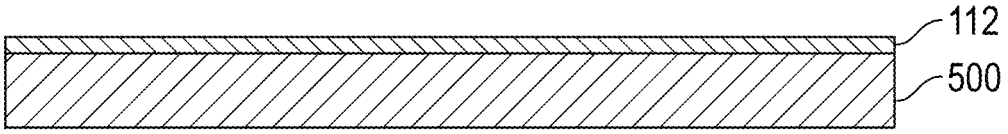
FIGS. 6A-6C illustrate aspects of a barrel for use in a pump system formed in accordance with certain teachings of this disclosure.

Referring first to FIG. 6A, in the illustrated example the barrel includes a tubular core element 500 (only a portion of which is illustrated). The tubular core element 500 may be formed from any suitable material, but in one embodiment is formed from a material comprising iron. Such a material may take the form of an iron alloy or steel, or any one any variant forms of steel. While the thickness of the tubular core element will vary, embodiments are envisioned in which the thickness is between 0.19 inches and 0.281 inches and, more specifically on the order of at least 0.19 inches.

In the example of FIG. 6A, a layer 112 is formed (e.g., through the use of an electroplating process) on the core element 500. In the illustrated example, the layer is formed from Nickel or a material that comprises Nickel. In the illustrated example of FIG. 6A, the material forming the layer 112 is substantially free from Boron. While the thickness of the layer 112 can vary—when considered across a dimension perpendicular (or normal to) the longitudinal access of the tubular element—the thickness of layer 112 will generally be less than the thickness of the core element 500 and can be on the order of 80 microns, and/or between approximately 80 microns and 160 microns.

In connection with the teachings of the present disclosure, once the Nickel containing layer 112 is formed on the core element 500, the layer 112 is exposed to a Boron containing mixture and subjected to a Boronization process (sometimes called a Boriding process). In this process Boron is diffused into a position of the exposed surface of the layer to a desired or predefined thickness. In exemplary embodiments the desired or predefined thickness is less than the original thickness of the layer 112 such that the result of the Boronization (or Boriding) process will be the creation of two regions within the layer 112, a first region 113 containing boron and a second region 112A substantially free of Boron. As reflected in the figure, in such an embodiment the second—substantially Boron free region 112A—will be closer to the core element 500 than the first region 113. The thickness of the Boron containing region can vary, but in some exemplary embodiments can be on the order of between about 40 microns to 80 microns.

In one exemplary embodiment, the Boron containing region of the layer 112 will comprise Nickel Boride (NiB).

Figure 6B:
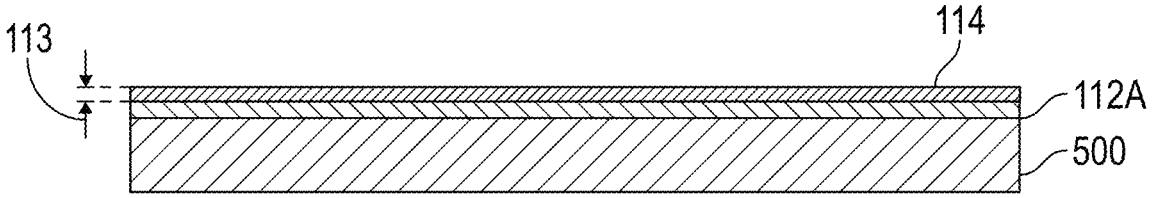

As reflected in FIG. 6B, in the described embodiment, the resultant structure will include an outer region of Nickel Boride, adjacent a region of Nickel that is substantially free of Boron, and the core element, with the region of Nickel substantially free of Boron being located between the core element and the outer region of Nickel Boride. In the illustrated example, both regions will have a relative hardness, wherein the harness of the region containing Boron will be greater than the relative hardness of the region that is substantially free of Boron. In further examples, the core element will have a relative hardness and relative harness of the core element will be greater than the relative hardness of the substantially Boron free region, but less than the relative hardness of the Nickel boride surface region.

Moreover, in the illustrated example, the both the region comprising Boron and the region substantially free of Boron will have a degree of corrosion resistance, wherein the degree of corrosion resistance of the region containing Boron will be less than the decree of corrosion resistance the region that is substantially free of Boron.

Figure 6C:
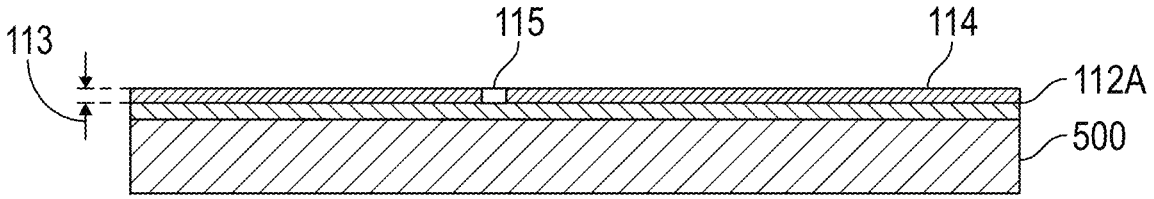

This structure, therefore, includes an outer hardened region 114 that will tend to protect the barrel from wear and deterioration, and an inner Nickel region 112 that can protect the core from corrosion. This is because the outer surface 114 will have a relative hardness that is significant and serves as a protective shield. However, because of its relative hardness, the outer region 114 can be brittle and subject to micro-cracking. Such micro-cracks, however, will not necessarily extend to the core element 500 because they will be halted by the relatively softer composition of the substantially Boron-free Nickel layer 112A. The substantially Boron-free nickel layer 112A can thus act as a barrier that can block any corrosive elements that may enter one of the micro-cracks within the outer layer 114, such as element 115 in FIG. 6C.

Figure 7A:
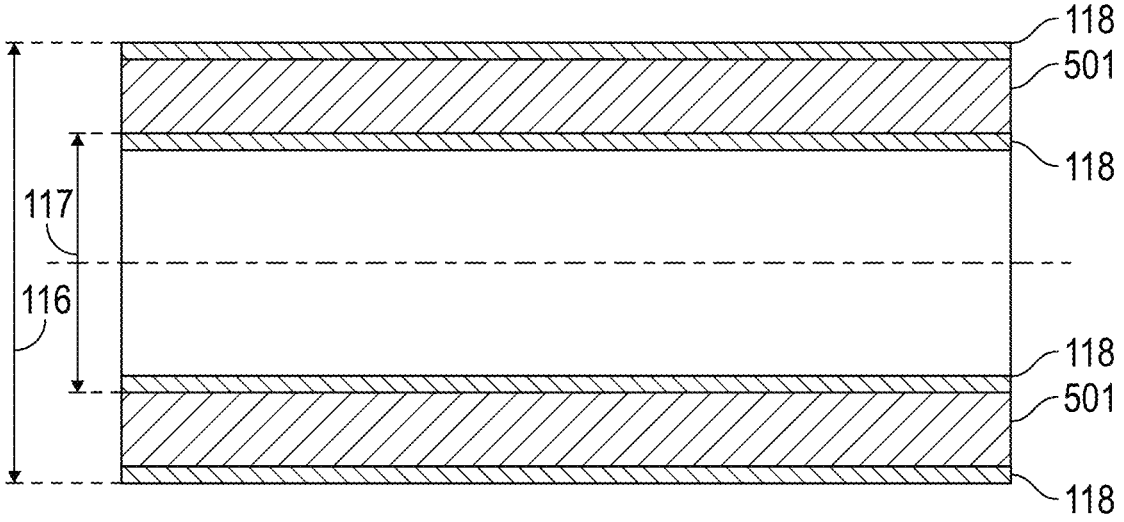
FIGS. 7A-7B illustrate an exemplary apparatus constructed in accordance with certain teachings of this disclosure in which a tubular element is subjected to a nickel plating process such that both the outer surface and the inner surface of the tubular element are plated to form interior and exterior Nickel plating layers and both such layers are subjected to a Boronization (or Boriding) process.
Figure 7B:
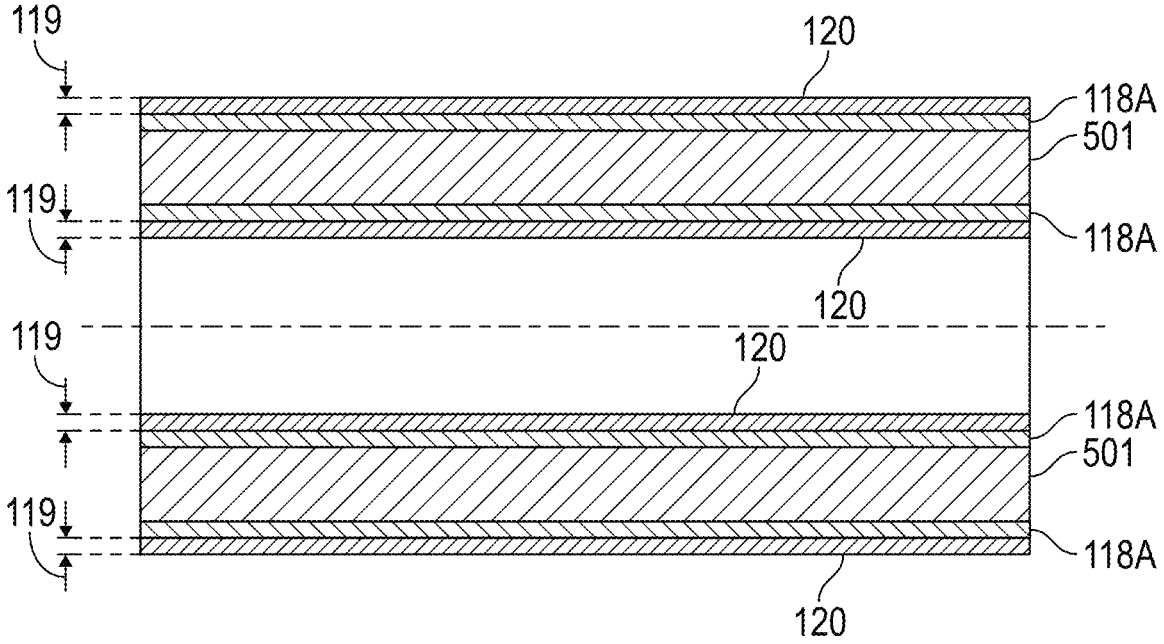

FIGS. 7A-7B, below, illustrate another embodiment incorporating aspects of the disclosed inventions, including one or more of structural components, elements and/or functional attributes as previously described concerning FIGS. 6A-6B, except as otherwise described.

As reflected above, in the embodiment FIGS. 7A and 7B the illustrated exemplary barrel includes a main (or core) tubular element including illustrated cross sectional portions 501. As reflected in the figure, the tubular core element will define a longitudinal axis and an interior surface and an exterior surface. Such tubular element may take the form of one of the tubular elements discussed above in connection with FIGS. 6A-6C.

In the example of FIGS. 7A-7B, the tubular element is subjected to a nickel plating process such that both the outer surface and the inner surface of the tubular element are plated to form interior and exterior Nickel plating layers 123. The result of such a process is reflected in FIG. 7A. In the example of FIG. 7A, the thicknesses of the interior and exterior Nickel plated layers may be substantially same, when considered across a distance normal (or perpendicular) the longitudinal axis of the tubular element or the thicknesses may vary. In one exemplary embodiment, the thickness of the interior Nickel layer is greater than the thickness of the exterior Nickel layer. In an alternate embodiment, the thickness of the exterior Nickel layer 123 is greater than the thickness of the interior layer. In one example, the thickness of both the interior and the exterior Nickel plated layers are in the range of approximately 8 microns to 160 microns.

In the example of FIGS. 7A and 7B, once the tubular object is subjected to the described Nickel plating process, both of the interior and the exterior Nickel plated surfaces 123 are subject to a Boronization process (sometimes called a boriding process) in which exposed Boron will diffuse into the surface 123 form regions including Boron which, in the example of FIG. 7B, can be a region comprising Boron Nitride. The remaining regions of the Nickel layer (in the example the regions closest to the tubular core will remain free, or substantially free, of Boron.

In the example of FIGS. 7A and 7B, the thickness of the Boron containing regions can be less than, equal to, or greater than the thickness of the region remaining substantially free of Boron. For example, in one embodiment, the thickness regions of the layers containing Boron can vary from approximately 40 microns to approximately 80 microns, while the thicknesses of the regions substantially free of Boron will be the thickness of such region before the Boronization process minus the thickness of the Boron containing region, and may vary from approximately 1 micron to 40 microns and/or from between 40 microns to 120 microns.

Figure 8A:
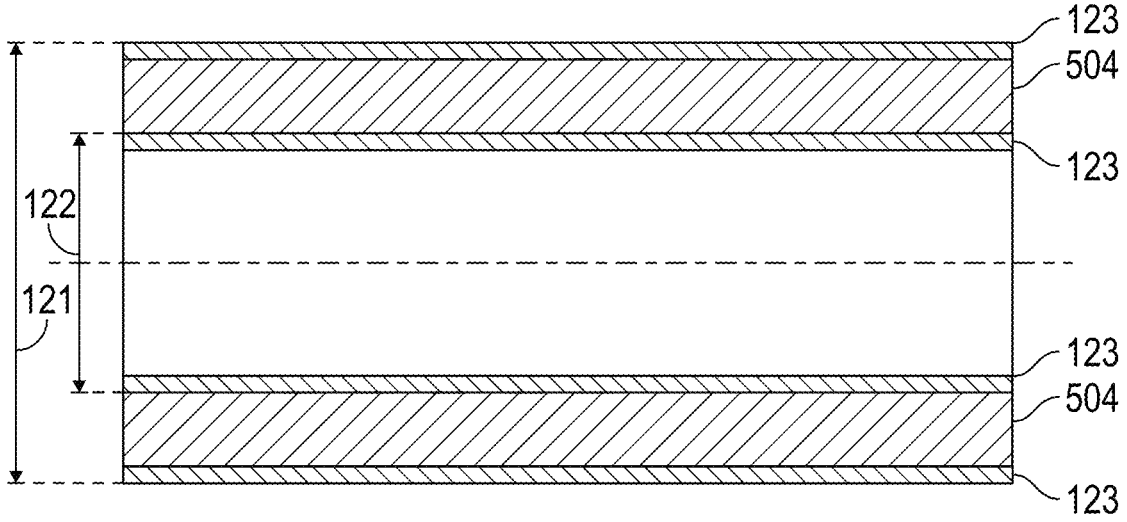
FIGS. 8A-8B illustrate an exemplary apparatus constructed in accordance with certain teachings of this disclosure in which a tubular element is subjected to a nickel plating process such that both the outer surface and the inner surface of the tubular element are plated to form interior and exterior Nickel plating layers but only the interior layer is subjected to a Boronization (or Boriding) process.
Figure 8B:
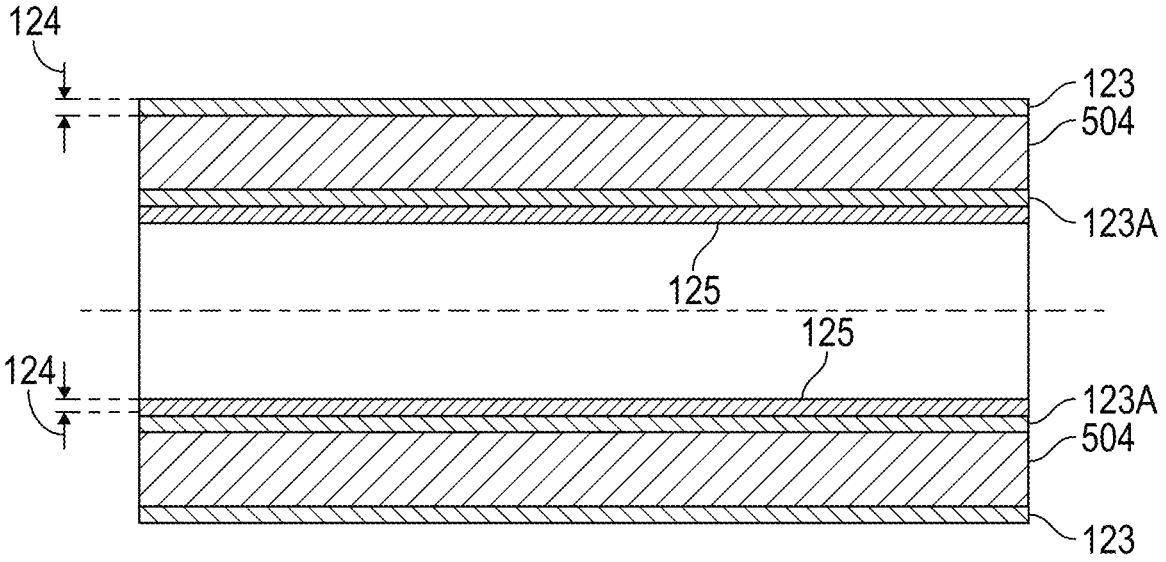

FIGS. 8A-8B, below, illustrate another embodiment incorporating aspects of the disclosed inventions, including one or more of structural components, elements and/or functional attributes as previously described concerning FIGS. 7A-7B, except as otherwise described.

As reflected above, in the embodiment FIGS. 8A and 8B the illustrated exemplary barrel includes a main (or core) tubular element including illustrated cross sectional portions 504. Such tubular element may take the form of one of the tubular elements discussed above.

In the example of FIGS. 8A-8B, the tubular element is subjected to a nickel plating process such that both the outer surface and the inner surface of the tubular element are plated to form an interior Nickel layer 123A and exterior Nickel layer 123. The result of such a process is reflected in FIG. 8A. The thicknesses of the Nickel layer 123 and 123A may be substantially same, when considered across a distance normal (or perpendicular) the longitudinal axis of the tubular element or the thicknesses may vary. In one exemplary embodiment, the thickness of the interior Nickel layer 123A is greater than the thickness of the exterior Nickel layer 123. In an alternate embodiment, the thickness of the exterior Nickel layer 123 is greater than the thickness of the interior layer 123A.

In the example of FIGS. 8A and 8B, once the tubular object is subjected to the described Nickel plating process, the interior surface 123A (but not the exterior surface 123) is subject to a Boronization process (sometimes called a Boriding process) in which it is exposed to a mixture containing Boron. As a result of this process, some of the exposed Boron will diffuse into the interior surface 124A to form a region 125 including Boron which, in the example of FIG. 8B will be a region comprising Boron Nitride. The remaining portion of the Nickel plated layer, specifically the region closest to the core of the tubular element, will remain substantially free of Boron.

In the example of FIGS. 8A and 8B, the thickness of the Boron containing region 125 can be less than, equal to, or greater than the thickness of the region remaining substantially free of Boron.

Many different manufacturing processes can be used to form a barrel for use in sucker rod assembly as discussed herein. One such process is depicted in FIG. 9, below.

Figure 9:
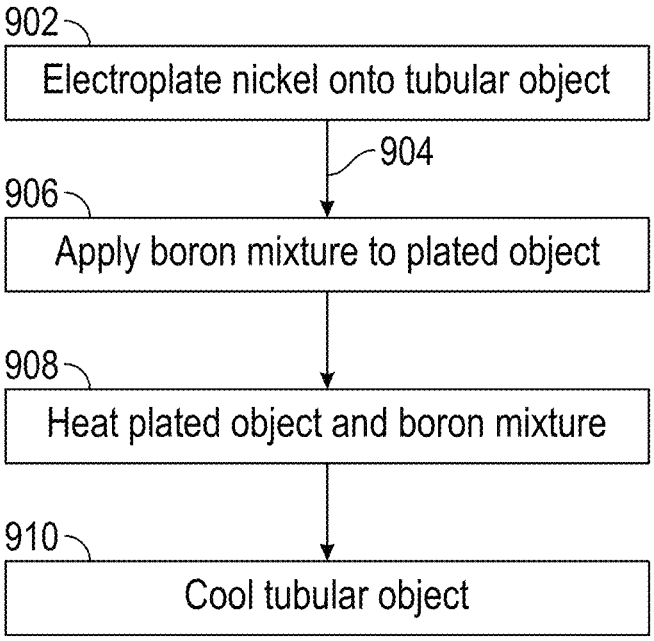
FIG. 9 depicts an exemplary manufacturing processes can be used to form a barrel for use in sucker rod assembly as disclosed herein.

Referring to FIG. 9, a first step 902 can be performed in which an electroplating operation is performed to electroplate a layer of Nickel onto a surface, for example an interior surface, or a tubular metal object, such as a steel barrel to form a Nickel plated tubular object. In one embodiment, this step of electroplating a layer of Nickel can comprises the duration of the electroplating step can be controlled such that the thickness of the resultant electroplated layer is equal to or greater than approximately 40 microns (in one embodiment), equal to or greater than 80 microns (in another embodiment) or within the range of 40 to 80 microns. In another embodiment, the duration of the electroplating step can be controlled such that the thickness of the resultant electroplated layer is between approximately 80 microns and 160 microns.

After a period of time reflected by line 904, a step 906 can be performed in which a mixture containing Boron is applied to the Nickel plated tubular object. This step can be performed in various ways. For example, this step can involve the application of a Boron containing gas to all or part of the Nickel plated tubular object. For example, where only an interior portion of the Nickel plated tubular object is to be exposed to the Boron containing gas, the gas can be pumped through the interior region of the tubular object. As another example, this step can involve the placement of the tubular object into a fluid containing Boron or packing a particle-based material containing Boron about the tubular object. In still further embodiments, this step can involve the application of a Boron continuing paste to the portions of the tubular object to which boron is to be exposed.

In the example of FIG. 9, once the Boron containing mixture is applied to the plated object, the plated object and the Boron containing mixture can be subjected to a step 908 where both the object and the mixture are heated. The result of such a heating step 908 can be the diffusion of boron particles into a region of the Nickel plating. Such diffusion can form a first region of the Nickel plating containing Boron (which can take the form of a Nickel Boride (NiB) region) and second region substantially free of Boron. More specifically, during the step 908, the extent and duration of the heating step can be controlled to ensure that a region of the electroplated Nickel layer is formed between the Nickel Boride region and the interior surface of the tubular metal object that is substantially free of Boron. In one embodiment, the step of controlling the extent and duration of the heating step further comprises the step of controlling the extent and duration of the heating step such that the thickness of the nickel-boride region is equal to or greater than approximately 40 microns.

As will be appreciated, because the heating step 908 results in a diffusion of Boron into the Nickel layer, the specific physical surface characteristics of the exterior surface are not determinative of the extent to which Boron can be infused into the layer. As such, it is not critical that the steps 906 and/or 908 occur within a limited time period after the Nickel electroplating step. For example, embodiments are envisioned where the Nickel electroplating step occurs at one location at time, and the application and heating steps 906 and 908 (or one of the two) occur a period of time 904 after the conclusion of the electroplating step 902. More specifically, embodiments are envisioned in which the duration 904 exceeds 60 minutes. This ability to perform the application and/or heating steps 906/908 relatively long after the electroplating step 902 can be contrasted with the operations required to create a Chromed Nickel surface, which require that the chroming operation be performed relatively soon after the Nickel plating and/or that the Nickel plated layer be activated before the chroming operation. This ability permits the process depicted in FIG. 9 to be implemented in an efficient and economical manner, with the steps potentially being performed at different locations at different times.

Following the heating step 908, the heated tubular object will be cooled at step 910.

Other and further embodiments utilizing one or more aspects of the inventions described above can be devised without departing from the spirit of Applicant's invention. Further, the various methods and embodiments of the methods of manufacture and assembly of the system, as well as location specifications, can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to protect fully all such modifications and improvements that come within the scope or range of equivalent of the following claims.

What is claimed:

1. A barrel for use in a sucker-rod pump assembly, comprising:

a tubular core element defining an interior surface and a longitudinal axis;

an interior layer formed on at least a portion of the interior surface, the interior layer including:

a first region comprising Nickel Boride, wherein the thickness of the first region, when measured in a direction perpendicular to the longitudinal axis, is in the range of approximately 40 microns to 80 microns; and a second region substantially free of Boron, wherein the thickness of the second region, when measured in a direction perpendicular to the longitudinal axis, is in the range of approximately 1 micron to 40 microns; and wherein the second region is closer to the interior surface of the core element than the first region, when considered in a direction perpendicular to the longitudinal axis.

2. The barrel of claim 1 wherein the second region consists of nickel plate.

3. The barrel of claim 1 wherein the tubular core element further defines an exterior surface and the barrel further comprises:

an exterior layer formed on at least a portion of the exterior surface, the exterior layer including:

a third region comprising Nickel Boride; and a fourth region substantially free of Boron; and wherein the fourth region is closer to the exterior surface of the core element than the third region, when considered in a direction perpendicular to the longitudinal axis.

4. The barrel of claim 1 wherein each of the first and second regions has a hardness, and wherein the hardness of the first region is greater than the hardness of the second region.

5. The barrel of claim 1 wherein each of the first and second regions has a degree of corrosion resistance, and wherein the degree of corrosion resistance of first region is less than the degree of corrosion resistance of the second region.

6. The barrel of claim 2 wherein the combined thickness of the first and second regions, when considered in a direction perpendicular to the longitudinal axis, is greater than the combined thickness of the third and fourth region, when considered in the same direction.

7. The barrel of claim 6 wherein the thickness of the second region, when considered in a direction perpendicular to the longitudinal axis, is within 5% of the thickness of fourth region, when considered in the same direction.

8. A method of forming a barrel for use in a sucker-rod pump assembly, the method comprising the steps of:

electroplating a layer of nickel onto an interior surface of a tubular metal object to form a nickel-plated tubular object;

applying a mixture containing Boron to the nickel-plated tubular object;

heating the nickel-plated tubular object and the applied Boron containing mixture over a period of time to cause at least some of the Boron within the mixture to diffuse into the nickel layer to form a region of Nickel Boride;

cooling the heated nickel-plated tubular object; and controlling extent and duration of the heating step to ensure that a region of the electroplated nickel layer is formed between the Nickel Boride region and the interior surface of the tubular metal object that is substantially free of Boron.

9. The method of claim 8 wherein the step of electroplating the layer of nickel further comprises the step of controlling the duration of the electroplating step such that the thickness of the resultant nickel electroplated layer is less than approximately 80 microns.

10. The method of claim 9 wherein the step of controlling the extent and duration of the heating step further comprises the step of controlling the extent and duration of the heating step such that the thickness of the Nickel Boride region is greater than approximately 40 microns.

11. The method step of claim 9, further comprising the step of controlling the duration of the electroplating step such that the thickness of the resultant nickel electroplated layer is greater than approximately 40 microns.

12. The method of claim 8 wherein the step of applying a mixture containing Boron to the nickel-plated tubular object comprises a step of exposing the nickel-plated tubular object to a gas containing Boron.

13. The method of claim 8 wherein a time duration separates the step of electroplating a layer of nickel onto an interior surface of a tubular metal object to form a nickel-plated tubular object from the step of applying a mixture containing Boron to the nickel-plated tubular object, and wherein the time duration is greater than approximately 60 minutes.

14. A barrel for use in a sucker-rod pump assembly, the barrel comprising a tubular member having an inner exposed surface comprising:

an exposed surface layer formed by subjecting a base material to a diffusion process, the exposed surface layer including a diffused element and having: (a) a thickness of between approximately 40 and approximately 80 microns, (b) a first relative hardness, and (c) a first relative resistance to corrosion;

an intermediate layer comprising the base material, the intermediate layering being substantially free of the diffused element and having: (a) a thickness of between approximately 1 and approximately 40 microns; (b) a second relative hardness, and (c) a second relative resistance to corrosion; and a core layer to which the intermediate layer was applied.

15. The barrel of claim 14 wherein the base material is Nickel.

16. The barrel of claim 15 wherein the exposed surface layer comprises Nickel Boride.

17. The barrel of claim 14 wherein the first relative resistance to corrosion is less than the second relative resistance to corrosion and wherein the first relative hardness is greater than the second relative hardness.

18. The barrel of claim 14 wherein core layer has a third relative hardness, and wherein the first relative hardness is greater than both the first relative hardness and the second relative hardness and wherein the second relative hardness is less than the third relative hardness.

19. The barrel of claim 14 wherein the core layer has a thickness of at least 0.19 inches.

20. The barrel of claim 14 wherein the exposed surface layer and the intermediate layer are formed through a process in which the core layer is subjected to a nickel plating process to produce a nickel plate; and the nickel plate is subject to a Boronization process to produce the exposed surface layer, wherein the exposed surface layer comprises Nickel Boride.

* * * * *